United States Patent [19]

Barchechat et al.

[11] Patent Number: 4,545,363

[45] Date of Patent: Oct. 8, 1985

[54] VENTILATION DAMPER CONTROL SYSTEM

[75] Inventors: Shlomo Barchechat; Norman Kolitsky, both of Chicago, Ill.

[73] Assignee: Safe-Air Inc., Chicago, Ill.

[21] Appl. No.: 627,840

[22] Filed: Jul. 5, 1984

[51] Int. Cl.[4] ..... F23L 3/00

[52] U.S. Cl. ..... 126/285 B; 98/86; 126/287.5; 251/129.03; 251/129.11

[58] Field of Search ..... 98/86; 126/285 R, 285 B, 126/287.5; 251/130, 133

[56] References Cited

U.S. PATENT DOCUMENTS

| | | | |
|---|---|---|---|
| 2,277,573 | 3/1942 | Wichorek | 251/133 |
| 2,717,759 | 9/1955 | Schofield et al. | 251/130 |
| 3,726,155 | 4/1973 | Denkowski et al. | 251/130 |
| 4,138,060 | 2/1979 | Iacono | 126/285 B |
| 4,164,936 | 8/1979 | Dottore, Jr. | 126/285 R |
| 4,177,716 | 12/1979 | Bowe et al. | 126/285 R |
| 4,327,894 | 5/1982 | Ewing et al. | 251/133 |

*Primary Examiner*—Ronald C. Capossela

*Attorney, Agent, or Firm*—Robert E. Wagner; Ralph R. Rath

[57] ABSTRACT

A control system for controlling movement of damper blades in a damper housing being open and closed positions consists of a support member having a driving link movable thereon and moved through a drive means. The driving link is biased to a closed position by a spring and is moved to an open position through the drive means, which is disengaged from the driving link through a power-operated member. The drive motor and the power-operated member connected to a power source through an electric circuit which incorporates switches and sensors that will automatically cause the damper blades to close under preselected conditions and a manual-override for remote-control and for manually overriding the temperature-sensing mechanism when desired.

18 Claims, 3 Drawing Figures

VENTILATION DAMPER CONTROL SYSTEM

DESCRIPTION

1. Technical Field

The present invention relates generally to smoke and/or fire detection devices and, more particularly, to a control system for operating a damper located in a fluid-circulating duct.

2. Background Prior Art

The use of damper units in ductwork forming part of the circulating or ventilation system for heating and conditioning of air therein has been known for many, many years. Conventionally, such damper units consist of an elongated housing that defines a central passage which forms part of the ductwork for the fluid-circulating system for a building.

The most common type of damper system for protection against fires generally consists of a plurality of louvers that are pivotally interconnected with each other and are attached to one side of the housing that forms the passage with a fusible link associated with the louvers and located within the passage so that the fusible link is severed whenever the temperature within the passage reaches a predetermined level. This type of louver system generally is designed to be either gravity-operated or spring-operated upon the fusion of the link to automatically close the passage and prevent any flow of air through the duct system.

Such a system has been very effective for installation into conventional ductwork that is generally rectangular in cross-section, which allows for the use of elongated louvers that can be pivotally interconnected along adjacent edges and attach to the upper wall of the duct and can be held open by the fusible link which is severed when the temperature reaches a predetermined level and the force of gravity automatically closes the louver, and thus the duct, when the link is severed. Alternatively, such pivotally-interconnected louver systems have also been installed in environments where the force of gravity is not needed to close the louvers when a predetermined temperature is reached within the ducts. This system incorporates a spring arrangement that cooperates with the louvers to normally bias the louvers to a closed position and holding the louvers in an open position through a fusible link.

In other systems, the duct or housing has a plurality of louvers pivoted within the passage and movable between open and closed positions through a common actuator, such that the flow of air through the duct is automatically interrupted whenever the louvers or damper blades are in a closed position.

With the recent advancements in circulating systems for larger buildings, it becomes almost essential to be capable of controlling the opening and closure of ducts within a large building through a central control panel, such as a maintenance panel, located in the main maintanence room of a building. With the advent of the more sophisticated type of air circulating systems, many of which are computer controlled, the need has been developed to replace the conventional gravity- or spring-operated fire damper systems with power-operated systems that can be remotely-controlled.

Furthermore, actual heat and/or flames many times are not directly responsible for fire-related fatalities, since smoke and other products of combustion have been shown to be the cause of the majority of fire-related fatalities.

Thus, a dire need has arisen for a control system for ventilation system ductwork that is capable of sealing the ductwork in the event of an actual fire, heat within the ductwork above a predetermined temperature, or smoke in the immediate vicinity, along with remote control for controlling the flow of ventilation air to any part of the ventilation system.

SUMMARY OF THE INVENTION

According to the present invention, a control system has been developed for a damper consisting of a housing that has damper blades located therein that are movable between open and closed positions and which can be remotely-controlled for normal control of air flow in a ventilation system and will automatically close upon the detection of a predetermined temperature level within the duct system, the detection of smoke or other toxic gases, and/or the event of a power failure for the ventilation system. The control system of the present invention is particularly adapted for controlling movement of damper blades within a damper housing that forms part of the ventilation system ductwork for a building.

The control system incorporates support means for supporting a driving link connected to the damper blades for moving the blades between open and closed positions through a power-operated drive means and a latching mechanism for coupling the drive means to the driving link. A biasing spring between the support means and the driving link normally biases the driving link and the blades to a closed position, while the drive means is utilized for moving the driving link to an open position and retaining the driving link in the open position until the occurrence of preselected conditions, such as heat detection, smoke detection or power failure.

The control system of the present invention includes a power-operated latch member that maintains engagement between the driving link and the drive means when power is supplied thereto, and disengages the driving link from the drive means whenever power is interrupted to the member. Power may be interrupted to the member through a power failure, the sensing of a predetermined temperature through a fusible link, the detection of smoke or flames, or a manually-operated switch, all incorporated into a control circuit between the power source and the member, as well as the drive means.

In the specific embodiment illustrated, the drive link consists of an elongated member that is reciprocated along the support means and has a gear rack defined thereon with the drive means including a drive gear driven by a motor connected to the power source and an engaging arm for moving the gear rack into and out of engagement with the drive gear and a magnetically-powered latch mechanism cooperating with the engaging arm for moving the arm between the two positions.

The control system also incorporates an electric circuit between the power source and the drive motor, as well as the magnetic or power-operated latch member, with the circuit incorporating a first switch for interrupting the circuit between the drive motor and the power source when the drive link reaches an open position and a further switch between the power source and the power-operated latch member, which is associated with a fusible link that interrupts the circuit to the latch member when the fusible link is severed. The electric circuit also incorporates a bypass circuit or switch for reconnecting the power source to the magnetic member for opening the damper unit while the fusible link is severed.

All of the mechanisms can easily be mounted within a housing that is attached to the damper housing and connected directly to the blade actuator, resulting in an extremely compact structure that has a minimum number of moving parts and yet is power-operated with the control being capable of being located at any central location within a building.

BRIEF DESCRIPTION OF SEVERAL VIEWS OF DRAWINGS

DETAILED DESCRIPTION

Figure 1:
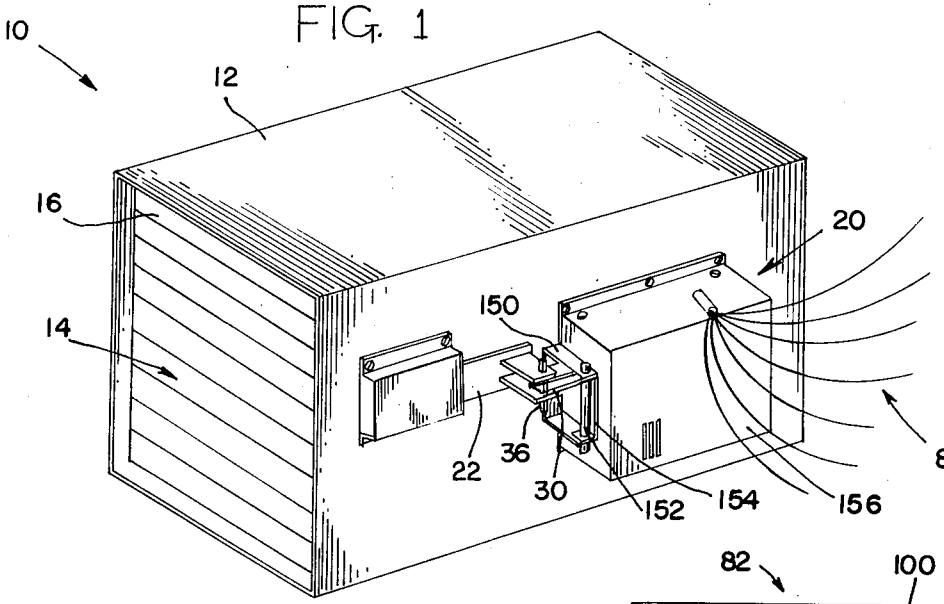
FIG. 1 shows a damper unit having the control system of the present invention incoporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows a damper unit generally designated by reference numeral 10, consisting of an elongated generally rectangular housing 12 that is open at opposite ends and defines an elongated passageway 14 having a plurality of damper blades 16 located therein. The damper blades in the illustrated embodiment are a plurality of spaced blades that are pivotally-supported on the housing and are moved between open and closed positions by a control system generally designated by reference numeral 20 and constructed in accordance with the teachings of the present invention. All of the louvers or damper blades 16 are connected to a single drive member or actuator 22, the movement of which is controlled by the control system that will now be described in connection with FIG. 2.

The control system 20 includes a main driving link 30 that is supported for movement on a support means, generally designated by reference numeral 32. The support means may be in the form of a generally elongated bracket that has an opening 34 at one end through which the link 30 projects and is connected through a pin 36 to the main actuator 22.

The driving link 30 is reciprocated along a path on the support member 32 in the direction of the arrows 38, shown in FIG. 1. A drive means, generally dessignated by reference numeral 40, cooperates with driving link 30 to move the driving link to a position corresponding to the open position of the damper blades 16 and a biasing means 42 normally biases driving link 30 to a position corresponding to the closed position for the damper blades or louvers 16. The biasing means 42 is in the form of a coil spring that has one end in engagement with support means 32 and an opposite end in engagement with a pin 44 that is carried by and moves with the driving link 30.

The drive means 40 consists of a drive motor 46 connected to a gear reducer unit 47 that has an output shaft 48 which has a worm gear 50 defined thereon in mesh with a worm gear 52. The worm gear 52 is driving drive gear 54 via output shaft 55 that is adapted to mesh with the gear rack 56 defined on one end of the elongated driving link 30.

The drive gear 52 and the gear rack 56 are adapted to be engaged and disengaged through an engaging means, generally designated by reference numeral 60. The engaging means is illustrated as being an arm 62 that is pivoted intermediate opposite ends on a pin 64 carried by support 32 and having a roller 66 rotatable on a pin 68 carried by one end of the arm 62. The roller 66 is adapted to engage the driving link 30 in a manner that will be subsequently described.

The opposite end of the engaging arm or release arm 62 is connected through a pin 70 to a movable magnetic member or plate 72 that cooperates with a magnet 74 that, when energized, will attract the plate 72 towards the magnet 74. The drive motor 46 and the magnet 74 are powered from a common power source 80 through a circuit means 82 that is shown schematically in FIG. 3.

Before describing the details of operation, the control circuit 82 and the various features incorporated therein and associated with the power source and the drive motor, will now be described. The circuit means 82 incorporates a first switch means 90 in series between motor 46 and power source 80 with the switch means 90 being shown in more detail in FIG. 2. The switch means 90 consists of a housing 92 mounted on support means 32 and having a normally closed contact 94 that is opened through a contact arm 96. Contact arm 96 is disposed in the path of movement of pin 44 on driving link 30, as will be described later.

The control circuit 82 also incorporates a further switch means 100 that is interposed between or in series with the power source 80 and the magnet 74. Switch means 100 includes a housing 101 mounted on support member 32 and has a normally closed contact 102 that is openable through a contact arm 104. The contact arm 104 is located in the path of a movable plunger 106 that is reciprocated on support means or member 32 and is biased through a coil spring 108. The support means 32 includes a bracket 110 that extends from one surface thereof and the bracket has a pin 112 which receives one end of a fusible link 114, the opposite end of which is connected to plunger 106. The fusible link 114 and bracket 110 are designed to be positioned within the housing 12, as will be described later. The circuit means 82 also incorporates a smoke/fire sensor 120 that is located between the power source 80 and the magnet 74, as well as motor 46.

The operation of the system so far described is believed to be apparent from the above description, but will be summarized at this point.

When the power source 80 is energized, circuit means 82 connects the power source 80 to motor 46 through the normally closed switch 90 and to magnet or power-operated member 74 through the normally closed switch 100. Energization of magnet 74 will draw magnetic plate 72 downwardly, as viewed in FIG. 2, and will pivot the arm 62 counterclockwise, as viewed in FIG. 2, to force roller 66 upwardly into engagement with the roller surface of the driving link 30, thus forcing gear rack 56 into mesh with drive gear teeth 54. Since the motor 46 is simultaneously energized, the motor will drive the worm gear 52 in a clockwise direction, as shown by the arrow, and will move the driving link 30 towards the left, as viewed in FIG. 2, and will compress coil spring 42. When the pin 44 engages switch arm 96, the circuit to the drive motor will be interrupted and the drive link will be stopped in a position corresponding to the open position for the damper blades 16. Since the magnet 74 remains energized at this time, the drive means 40 will hold the driving link in the open position with the coil spring or compression spring 42 remaining compressed. This position will be maintained so long as power is being supplied to circuit 82, which will maintain magnet 74 energized, which in turn will keep gear rack 56 in mesh with drive gear teeth 54 through the engaging arm 62. In the event that there is a power failure, magnet 74 will become de-energized and the magnetic field will cause plate 72 to move upwardly, piovting release arm 62 counterclockwise to allow the drive link, particularly gear rack 56, to disengage from drive gear 54. The coil spring 42 will thus take over and move the drive link and the damper blades 16, connected thereto, to a closed position. The damper blades or louvers 16 will thus remain in the closed position until power is restored.

Figure 2:
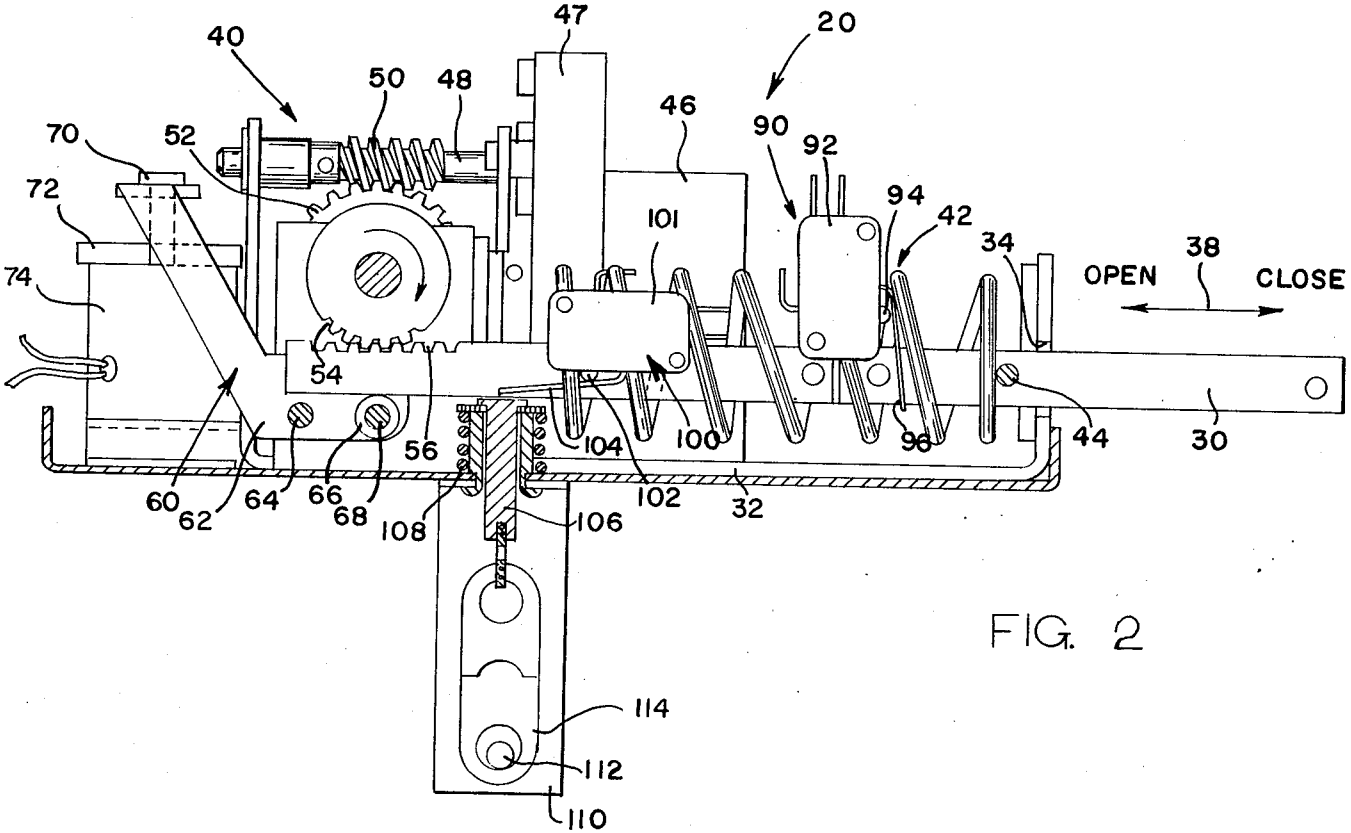
FIG. 2 is an enlarged fragmentary cross-sectional view of the control system shown in FIG. 1; and, FIG. 3 is a schematic view of the electric circuit for the control circuit.

In the event there is a rapid increase in temperature within the passageway 14, such increase in temperature will fuse the fusible link 114 and will release the plunger 106 so that coil spring 108 will force the plunger upwardly, as viewed in FIG. 2, to open the switch 100 and interrupt the circuit to the magnet 74, thereby disengaging the gear rack 56 from drive gear 54 and the spring 42 will again close the damper blades.

In the event that there is fire or smoke in the immediate vicinity of the duct system, such smoke or fire will be detected by sensor 120, which again will interrupt the circuit between the power source 80 and the magnet 74, as well as the motor 46, and the spring 42 will move the damper blades to a closed position.

Figure 3:
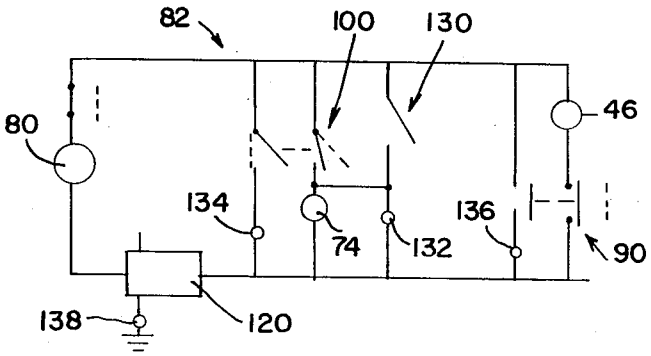

According to one aspect of the present invention, the control system also incorporates a manual bypass to bypass the switch means 100 in the event that the fusible link 114 becomes severed and the operator wishes to open the damper blades without replacement of the fusible link. As illustrated in FIG. 3, a manually-operable bypass switch 130 is located in parallel with switch 100 and may be closed by an operator to energize magnet 74, which in turn will engage the gear rack 56 with the drive gear 54 and motor 46 will move the louvers 16 to an open position. The system may also incorporate indicator lights to indicate each of the conditions of having the damper blades open, closed or opened through the manual-override system. For example, indicator lights 132, 34, 136 and 138 may be included in circuit 82.

Preferably, the entire control unit 20 is releasably supported on housing 12 through a pair of brackets extending from mounting plate 150 fastened onto the housing 12 and adapted to receive two pins 152, one in front and one in the back of the unit 20, which extend through a bracket 154 on the cover 156 that may form part of the control system illustrated in FIG. 1.

It should be noted that the bracket 110 and fusible link 114 extend rearwardly from the support means 32 through an opening (not shown) into the passageway 14 to act as a temperature-sensing means for sensing the temperature of the air flowing within the ductwork.

Thus, it will be appreciated that the present invention provides an extremely simplified, compact control unit which can easily be separately manufactured and which can easily be assembled on-site and connected to either existing damper units having a single control member without any extensive modification thereof or can be supplied as original equipment.

Of course, various modifications come to mind without departing from the spirit of the ivnention. For example, magnet or power-operated member 74 and release arm 62, which may be considered latch means, could be replaced with a power-operated solenoid having a plunger biased to a retracted position and a roller at its free end engageable with drive link 30. Also, the driving link need not be the elongated reciprocating member and could be a rotating member in situations where a rotary actuator is used to move the damper blades.

We claim:

1. A control system for controlling movement of damper blades in a damper housing between open and closed positions comprising support means having a driving link movable thereon and connectable to said blades for moving said blades between open and closed positions, biasing means between said support means and said driving link for biasing said link to a position corresponding to said closed position, drive means cooperating with said driving link for moving said driving link, engaging means on said support means producing engagement between said drive means and said driving link so that energization of said drive means will move said link from said position corresponding to said closed position to a position corresponding to said open position, and latch means cooperating with said engaging means normally maintaining engagement between said driving link and drive means to hold said driving link in said position corresponding to said open position, said latch means being responsive to preselected conditions to release said engaging means and allow said biasing means to move said driving link to said closed position; said latch means including a magnetic member with a power source and circuit means connecting said power source to said magnetic member, and switch means in said circuit means actuatable to separate said power source from said magnetic member.

2. A control system as defined in claim 1, in which said driving link is an elongated link reciprocated along a path on said support means between said open and closed positions.

3. A control system as defined in claim 1, further including a heat-fusible link carried by said support means producing one of said preselected conditions for said latch means to release said engaging means upon fusion of said heat-fusible link.

4. A control system as defined in claim 1, further including a fusible link and a plunger reciprocated on said support means and connected to said fusible link, said plunger actuating said switch means in response to fusion of said fusible link.

5. A control system as defined in claim 1, in which said engaging means includes an arm pivoted on said support means and having a biasing surface engaging said drive link with said drive link having a gear rack engageable with said drive means.

6. A control system as defined in claim 5, in which said drive means includes a drive gear adapted to mesh with said gear rack and a motor for driving said drive gear, a power source and circuit means between said power source and said motor having switch means actuated by said drive link to interrupt said circuit means and define said open position.

7. Apparatus for controlling a damper including a housing having louvers movable therein and a member for moving said louvers between open and closed positions, comprising a movable link connectable to said member, support means for controlling movement of said link along a path, biasing means biasing said link to a first position corresponding to said closed position of said louvers, drive means for moving said link from said first position and said louvers from said closed position toward said open position, and engaging means for producing engagement and disengagement between said drive means and said movable link; said engaging means including a power-operated member with a power source, and circuit means connecting said power source to said power-operated member, said power-operated member producing disengagement between said movable link and said drive means when said power source is disconnected from said power-operated member.

8. Apparatus as defined in claim 7, further including a heat-fusible link carried by said support means with said circuit means including switch means between said power source and said power-operated member actuated upon severance of said fusible link to disconnected said power source from said power-operated member.

9. Apparatus as defined in claim 8, further including smoke/fire sensor means in said circuit means to disconnected said power source from said power-operated member.

10. Apparatus as defined in claim 8, further including bypass means in said circuit means operable to bypass said switch means and reconnect said power source to said power-operated means while said switch means is actuated.

11. Apparatus as defined in claim 10, in which said circuit means includes second switch means between said drive means and said power source and operable by said movable link to define said open position for said movable link.

12. Apparatus as defined in claim 11, in which said movable link is an elongated bar reciprocated along said path and having a gear rack thereon, and said drive means includes a drive gear driven by a motor and having gear teeth meshable with said gear rack with said power-operated member producing engagement and disengagement between said gear rack and said gear teeth.

13. In combination with a damper having a housing defining a passage and damper blades in said passage with an actuator connected to said blades for moving said blades between open and closed positions, a driving link reciprocated on a support member and connected to said housing with said link connected to said actuator, biasing means between said link and said support member for biasing said link to said closed position, drive means engageable with said link to move said link to said open position and maintain said link in said open position, a power-operated member for engaging and disengaging said link and said drive means, a power source and circuit means connecting said power source to said power-operated member and said drive means, said circuit means including switch means between said power source and said power-operated member and temperature-sensing means in said passage to open said switch means when the temperature in said passage rises above a predetermined level.

14. The combination as defined in claim 13, in which said circuit means includes smoke and fire sensor means operable to disconnected said power source from said power-operated means upon detection of smoke or fire.

15. A control system for controlling movement of damper blades in a damper housing between open and closed positions comprising support means having a driving link movable thereon and connectable to said blades for moving said blades between open and closed positions, biasing means between said support means and said driving link for biasing said link to a position corresponding to said closed position, drive means cooperating with said driving link for moving said driving link, engaging means on said support means producing engagement between said drive means and said driving link so that energization of said drive means will move said link from said position corresponding to said closed position to a position corresponding to said open position, said engaging means includes an arm pivoted on said support means and having a biasing surface engaging said drive link with said drive link having a gear rack engageable with said drive means, and said drive means including a drive gear adapted to mesh with said gear rack and a motor for driving said drive gear, a power source and circuit means between said power source and said motor having switch means actuated by said drive link to interrupt said circuit means and define said open position, and latch means cooperating with said engaging means normally maintaining engagement between said driving link and drive means to hold said driving link in said position corresponding to said open position, said latch means including a power-operated member connected to said power source and cooperating with said arm for maintaining engagement between said gear rack and said drive gear and accommodating disengagement upon interruption of said power source to allow said biasing means to move said drive link to said closed position, said latch means also being responsive to preselected conditions to release said engaging means and allow said biasing means to move said driving link to said closed position.

16. A control system as defined in claim 15, in which said circuit means includes further switch means between said power source and said power-operated member, and a heat-fusible link on said support means and cooperating with said further switch means to isolate said power-operated member from said power source upon fusion of said fusible link.

17. A control system as defined in claim 16, in which said circuit means includes bypass means for accomodating connection of said power source to said power-operated member after fusion of said fusible link.

18. A control system as defined in claim 17, in which said circuit means includes a smoke/fire sensor for interrupting said circuit when smoke or fire is detected.

* * * * *